United States Patent [19]

Hammes

[11] 4,347,947

[45] Sep. 7, 1982

[54] CONTAINER AND COVER WITH TWO GASKET SEAL

[75] Inventor: Theo Hammes, Ingenieur, Fed. Rep. of Germany

[73] Assignee: Mauser-Kommandit Gesellschaft, Bruhl, Fed. Rep. of Germany

[21] Appl. No.: 216,647

[22] Filed: Dec. 15, 1980

[30] Foreign Application Priority Data

Dec. 14, 1979 [DE] Fed. Rep. of Germany ... 7935222[U]

[51] Int. Cl.[3] ..... B65D 53/00

[52] U.S. Cl. ..... 220/378; 220/319

[58] Field of Search ..... 220/304, 319, 320, 321, 220/378; 215/341

[56] References Cited

U.S. PATENT DOCUMENTS 4,177,934 12/1979 Hammes et al. ..... 220/319

4,231,489 11/1980 Malone ..... 220/304

*Primary Examiner*—George T. Hall

*Attorney, Agent, or Firm*—Pennie & Edmonds

[57] ABSTRACT

A plastic container for storing fluids having a neck (3) with an opening closed by means of a plastic cover (4) is disclosed. An annular portion of the cover (4) surrounds the neck (3) thus providing an inner rim (9) and an outer rim (8) in the cover (4). A first gasket (7) inserted between these rims is pressed against the upper edge of the neck (3) and a second radially and axially supported gasket (10) between the cover (4) and the neck (3) are compressed under the action of a means for biasing the cover (4) toward the neck (3) to seal the cover on the container. Means are provided to limit the motion of the cover (4) axially towards the neck (3) to prevent the first gasket (7) from being damaged.

5 Claims, 1 Drawing Figure

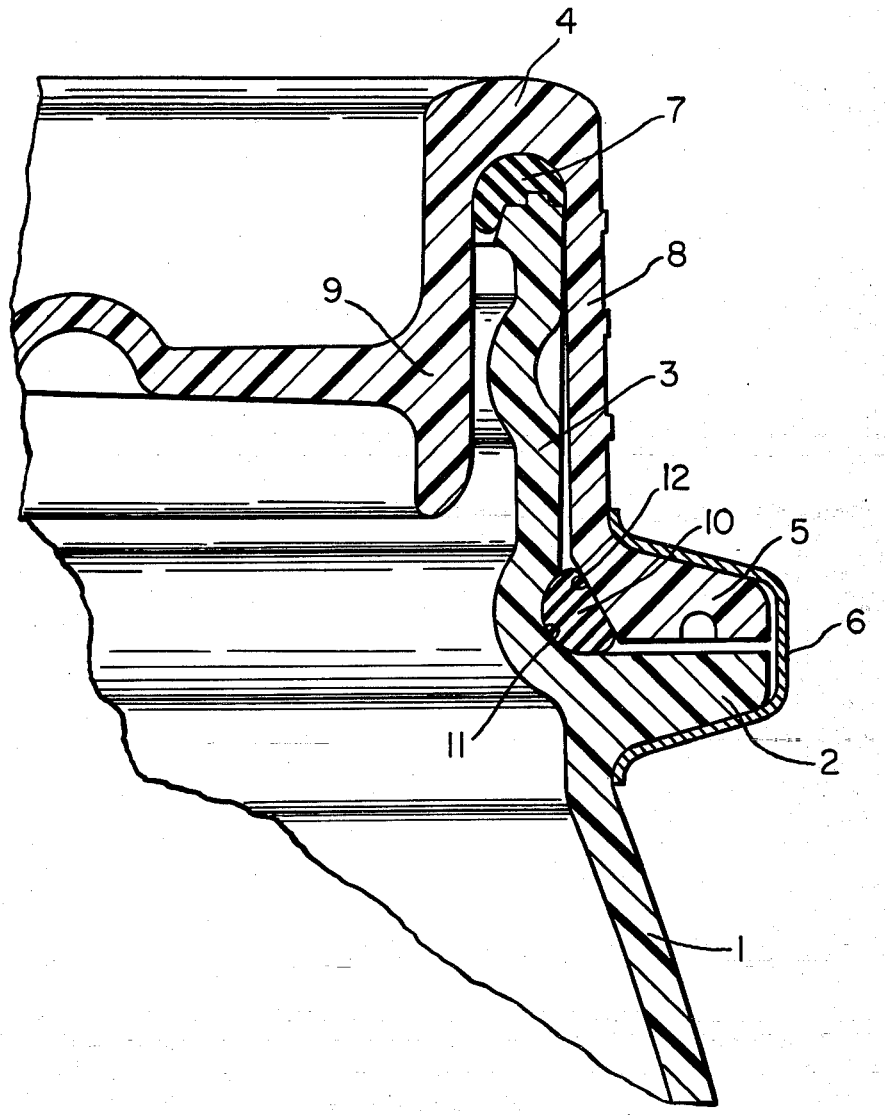
4
7
8
9
3
12
10
5
6
11
2
1

CONTAINER AND COVER WITH TWO GASKET SEAL

FIELD OF INVENTION

This invention relates to a plastic container or drum that can be closed by means of a plastic cover. More particularly, it relates to such a drum employing gaskets arranged to effectively seal the drum under high axial loads and during rough handling.

BACKGROUND ART

It is generally known that a gasket may be inserted between the cover and the neck of the opening of a container or drum to effect a seal which prevents the contents of the drum from flowing out, even if relatively high surge pressures result for example, when a drum is toppled from a stack. However, the gasket may be overstressed or destroyed by squeezing when the drum topples on to its cover or when high axial loads occur. U.S. Pat. No. 4,177,934 to Hammes et al. for Container and Lid disclosed a container which avoids this difficulty by providing abutting container and cover flanges to limit the motion of the cover.

In internal pressures are high enough when a drum topples the sealing ability of the gasket can be briefly overcome, and at the moment that the toppling drum strikes, a small amount of the contents of the drum can emerge. While this loss may be neglible as compared to the total volume of the drum, if the drum is filled with a hazardous material, such emergence of fluid is intolerable.

DISCLOSURE OF THE INVENTION

The container or drum of this invention has a drum or border flange that protrudes from the drum jacket at a distance below the drum opening. An outer rim flange of the cover for the drum is bent radially outward. Under an axial load, the cover flange moves into contact with the protruding drum flange preventing further axial motion. Thus, a gasket inserted between the inner and the outer rim of the cover and overlying the neck of the drum opening is protected from being overstressed or destroyed.

To reliably prevent the emergence of minimal amounts of the contents of the drum, even under rough operating conditions, a second gasket is provided between the cover the drum flanges. This second gasket, which may be embedded in a curved annular depression in the transition region between the drum flange and neck has a surface which contacts a sloping inner edge of the cover flange.

BRIEF DESCRIPTION OF THE DRAWING

The drawing is a cross-section of a portion of a container and cover according to the invention.

DETAILED DESCRIPTION OF THE INVENTION

Referring to the drawing, the head of a drum gradually rises from the belly 1 of the drum and goes over into the nearly vertical ring area, to which is connected the continuous border or annular flange 2, which is directed radially outward in a direction perpendicular to the longitudinal axis of the drum. The neck 3 of the opening rises upwards from the inner rim of flange 2. An annular portion of the cover 4 is turned up on the neck 3 of the opening. Cover 4 has an outer rim flange 5, which is directed radially outward in the same fashion as flange 2. Outer rim flange 5 is tensioned or biased toward or against flange 2 by means of a tension ring 6. A gasket 7 is inserted between the outer rim 8 and the inner rim 9 of cover 4. Gasket 7 is pressed against the upper edge of neck 3. In the condition shown, the lower surface of the outer rim flange 5 is situated at a slight distance above the surface of drum flange 2. When cover 4 is not subject to great loads, this distance between cover flange 5 and drum flange 2 is maintained because of the elasticity of gasket 7. As the axial load increases, this distance diminishes to such an extent that, under heavy loads, the lower surface of cover flange 5 contacts the surface of flange 2. In this position, further movement of cover 4 is blocked, so that gasket 7 cannot be overstressed or destroyed.

While this is a precondition for protecting gasket 7 in the event that a filled drum topples, to reliably prevent the emergence of minimal amounts of the contents of the drum, even under rough operating conditions, a second gasket 10 is provided.

Gasket 10, which is supported both radially by neck 3 and axially by flange 2, is embedded in a curved concave annular depression 11 in the transition region between the surface of the border or flange 2 and the adjoining neck 3 of the opening. The slanted inner edge 12 of the outer rim flange 5 of cover 6 abuts the free outer surface of gasket 10.

What is claimed is:

1. A container for storing fluids having a neck with an opening, a cover for attachment to said neck, said cover having an inner rim disposed internally of the neck of the container and an outer rim disposed externally of said neck in circumventing relation therewith, a first gasket disposed between the inner rim and the outer rim of the cover in engagement with the upper edge of said neck to space the cover axially from said upper edge by a predetermined distance, a first flange on the outer rim of the cover extending radially outward thereof, a second flange on the container extending radially outward thereof and axially facing the first flange in spaced relationship therewith said spacing being less than said predetermined distance by which the cover is axially spaced from the upper edge of the container neck and an annular connecting element operative for urging said first and second flanges together into alignment in the axial direction of the container, wherein the improvement comprises a second gasket supported radially and axially said second gasket in contact with said cover and said neck.

2. The container of claim 1 wherein said second gasket is located in a transition region between said second flange and said neck.

3. The container of claim 2 further comprising in said transition region a curved annular depression in which said second gasket is embedded.

4. The container of claim 2 wherein the second flange has a slanted inner edge facing said second gasket for engagement with a surface of said second gasket.

5. The container of any of claims 1 through 4 wherein said annular connecting element is a tension ring which surrounds said first and second flanges.

* * * * *